US007125135B2

(12) United States Patent
Ward

(10) Patent No.: US 7,125,135 B2
(45) Date of Patent: Oct. 24, 2006

(54) WALL-WASH LIGHT FIXTURE

(76) Inventor: Patrick Ward, 3427 Heather Bluff, San Antonio, TX (US) 78259

( * ) Notice: Subject to any disclaimer, the term of this patent is extended or adjusted under 35 U.S.C. 154(b) by 143 days.

(21) Appl. No.: 10/697,058

(22) Filed: Oct. 30, 2003

(65) Prior Publication Data

US 2004/0090784 A1 May 13, 2004

Related U.S. Application Data

(60) Provisional application No. 60/422,334, filed on Oct. 30, 2002.

(51) Int. Cl.
*F21V 21/30* (2006.01)
*F21S 8/00* (2006.01)

(52) U.S. Cl. ..... 362/147; 362/285; 362/364; 362/370; 362/427

(58) Field of Classification Search ..... 362/147, 362/287, 285, 364, 365, 368, 370, 418, 427
See application file for complete search history.

(56) References Cited

U.S. PATENT DOCUMENTS 3,643,089 A * 2/1972 Marantz ..... 362/217
4,232,361 A * 11/1980 Kelsall ..... 362/364
4,623,956 A * 11/1986 Conti ..... 362/148
5,457,617 A * 10/1995 Chan et al. ..... 362/366
5,562,343 A * 10/1996 Chan et al. ..... 362/365
5,823,664 A * 10/1998 Demshki et al. ..... 362/366
5,951,151 A * 9/1999 Doubeck et al. ..... 362/365
6,082,878 A * 7/2000 Doubek et al. ..... 362/365
6,375,338 B1 * 4/2002 Cummings et al. ..... 362/276
6,431,723 B1 * 8/2002 Schubert et al. ..... 362/147
6,632,006 B1 * 10/2003 Rippel et al. ..... 362/366
6,655,813 B1 * 12/2003 Ng ..... 362/148
6,755,559 B1 * 6/2004 Wang et al. ..... 362/368
6,779,908 B1 * 8/2004 Ng ..... 362/147
6,802,627 B1 * 10/2004 Fischer et al. ..... 362/269

* cited by examiner

*Primary Examiner*—Ali Alavi
*Assistant Examiner*—Jacob Y. Choi
(74) *Attorney, Agent, or Firm*—Strasburger & Price, LLP; Alan R. Thiele

(57) ABSTRACT

A wall-wash light fixture for providing substantially uniform wall illumination includes a light source mounted to direct emitted light to a substantially arcuate kick reflector. The substantially arcuate kick reflector directs the emitted light toward the wall.

18 Claims, 4 Drawing Sheets

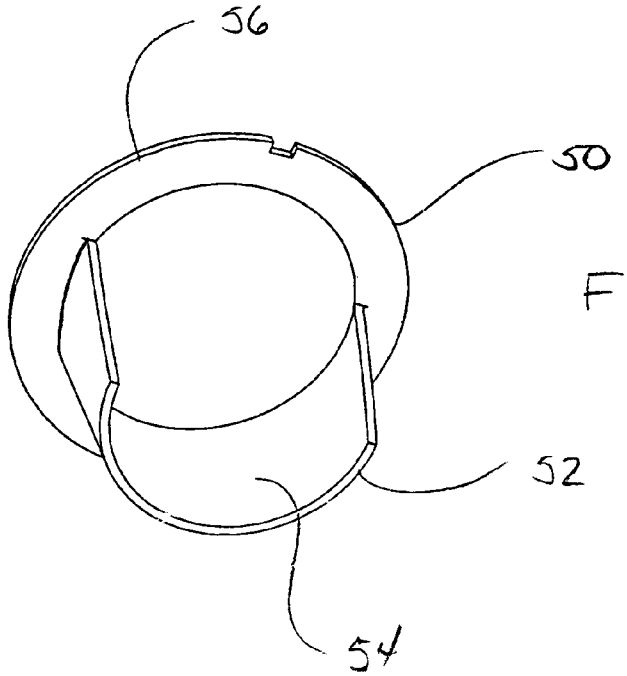
FIG. 4A
FIG. 4B
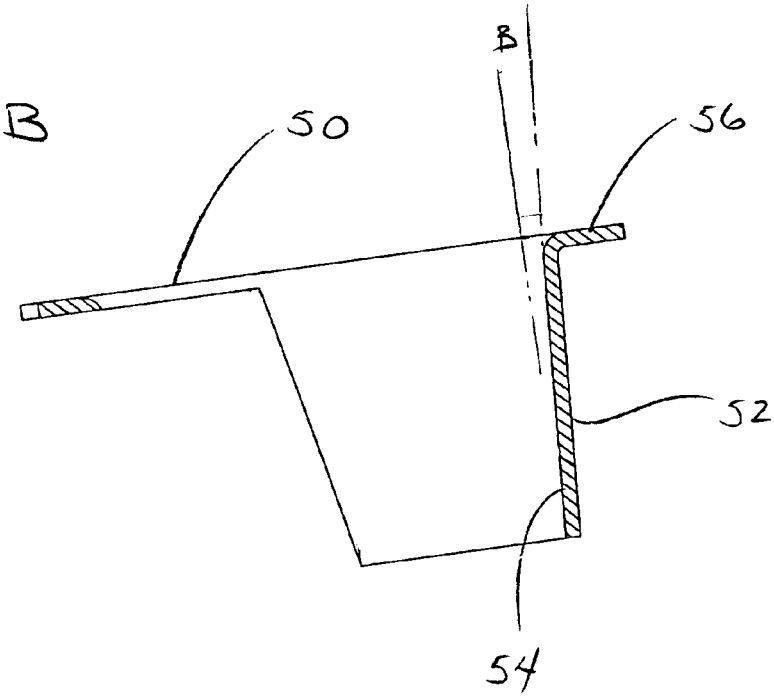

WALL-WASH LIGHT FIXTURE

REFERENCE TO RELATED APPLICATION

This application claims priority from U.S. Provisional Patent Application Ser. No. 60/422,334 filed Oct. 30, 2002.

FIELD OF THE INVENTION

The present invention pertains to light fixtures; more particularly, the present invention pertains to light fixtures typically used for illuminating substantially vertical surfaces such as a wall.

BACKGROUND

Interior designers often use lighting to create visual effects within a room. One of the more popular dramatic effects includes illuminating a vertical surface such as a wall with light. The light fixtures designed to illuminate a wall are typically called wall-wash fixtures. If a wall-wash light fixture is mounted in a ceiling, it falls into a class of lighting fixtures known as down lights. If a wall-wash light fixture is positioned near the floor, it is called an up-light.

Ceiling mounted down light fixtures, particularly those whose bottom surface is substantially flush with a ceiling surface, typically include a housing which extends upwardly through a hole in a ceiling panel. The housing provides a mounting for the light source, electrical connections for the light source, and a mounting for the visible portion of the trim ring assembly. Ceiling mounted down light fixtures are used to provide illumination in many residential, commercial, and educational buildings.

Most ceiling mounted down light fixtures are used for direct room illumination; however, some ceiling mounted down light fixtures are used to create a wall-wash lighting effect. Such wall-wash lighting effect from ceiling mounted down lights is often created by directing the light rays from the light source at an angle with respect to a plane perpendicular to the ceiling. However, to properly direct the light toward the wall to be illuminated, it is often necessary to either enlarge the opening in the trim ring through which light passes or to move the light source to a position below the ceiling surface. Neither of these two solutions is generally acceptable to interior designers.

When floor mounted up-light fixtures are used to create wall-wash light, they are often tilted toward the walls to direct the light rays emitted by the light source. However, the result from tilting an up-light fixture toward a wall is strong illumination near the lighting fixture and the appearance of a parabolic-shaped lighting pattern.

Because of the continued desire of interior designers to obtain unique and dramatic lighting effects with wall-wash lighting fixtures, a variety of different wall-wash light products are now available. While presently available ceiling or floor mounted wall-wash light fixtures are able to illuminate wall surfaces, problems still remain. First, most of the commonly available wall-wash light products provide an illumination pattern which produces substantially different light intensities on substantially vertical wall surfaces. Second, most of the commonly available wall-wash light fixture products do not fully and uniformly direct light toward the surface to be illuminated. Specifically, the pattern of light on the wall to be illuminated includes noticeable dark areas either near the top or near the bottom of the wall. These dark areas extend into the corners where the wall joins either the ceiling or the floor. Third, wall-wash light fixture products with a large opening in the trim ring or with the light source extending outwardly from the wall-wash lighting product create an appearance unacceptable to most interior designers.

Accordingly, there remains a need in the art for a wall-wash light fixture which provides a substantially uniform wall illumination pattern, illuminates a large portion of the wall, and minimizes the size of the dark areas where the wall intersects the ceiling or the floor, while at the same time presenting an unobtrusive appearance acceptable to room designers.

SUMMARY

The disclosed wall-wash light fixture provides a substantially uniform wall illumination pattern, illumines a large portion of the wall, and minimizes the size of dark areas, while at the same time presenting an unobtrusive appearance acceptable to room designers.

Occupants of a room including the ceiling mounted down light embodiment of the wall-wash light fixture of the present invention will observe a trim ring assembly including an external portion positioned against or mounted flush with a ceiling surface, with a relatively small unobtrusive hole in the visible portion of the trim ring assembly.

Extending upwardly from the trim ring assembly in the ceiling mounted down light embodiment, through a hole in the ceiling, is a housing portion. The housing portion provides a mounting for the trim ring assembly and encloses a light source positioning ring for determining the angular position of the light source with respect to a plane perpendicular to the plane of the ceiling. The light source positioning ring includes an upper surface which is angled away from the wall surface to be illuminated. This upper angled surface of the light source positioning ring causes the light from the light source to be directed away from the wall to be illuminated and toward a curved planar reflecting surface within a substantially arcuate kick reflector. The substantially arcuate kick reflector is positioned by and contained within the light source positioning ring.

The combination of the angled mounting of the light source on the light source positioning ring with the position and substantially arcuate shape and curved planar reflecting surface of the kick reflector first directs the light from the light source away from the wall surface to be illuminated and then captures and reflects the light rays through the opening in the visible portion of the trim ring assembly toward the wall. The curved planar reflecting surface on the inside of the kick reflector, together with its substantially arcuate shape, disperses the light rays to produce a substantially uniform illumination pattern on the wall surface. Unlike other wall-wash light fixture products, the wall-wash down light of the present invention not only provides a substantially uniform pattern of illumination on the wall, but also illuminates a larger area, thus minimizing the size of the dark areas often found near the top or the bottom of an illuminated wall.

Occupants of a room including the floor mounted embodiment of the wall-wash up-light fixture of the present invention may or may not see the light fixture itself. However, the construction of the up-light fixture is substantially the same as the down light fixture in that the light source is mounted at an acute angle with respect to a plane perpendicular to the plane of the floor and a substantially uniform pattern of illumination is provided by the use of the substantially arcuate kick reflector.

BRIEF DESCRIPTION OF THE DRAWING FIGURES

A better understanding of the wall-wash light fixture of the present invention may be had by an understanding of the drawing figures, wherein:

FIG. 4A is a perspective view of the substantially arcuate kick reflector; and FIG. 4B is a side elevational view, in partial section, of the substantially arcuate kick reflector.

DESCRIPTION OF THE EMBODIMENTS

Figure 1:
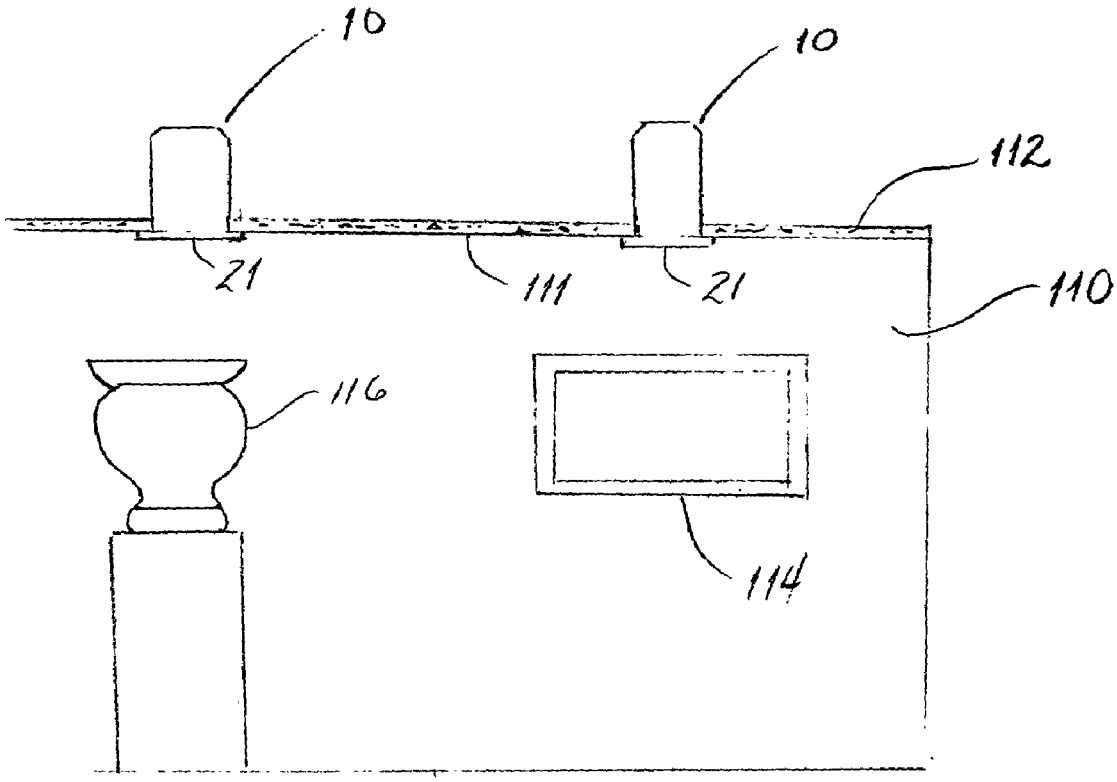
FIG. 1 is a front elevational view in partial section of a room showing the mounting of the disclosed wall wash down light fixture in the ceiling.

As may be seen in FIG. 1, the ceiling mounted down light embodiment of the disclosed wall-wash light fixture of the present invention 10 is designed for use in a room wherein the light from a ceiling 112 mounted down light is used to illuminate an adjoining wall 110 surface. In some prior art down light fixture products, the light source within the housing portion of the down light is simply tilted towards the wall surface to be illuminated. While some light from these prior art down light fixture products does illuminate the wall, a portion of the light emitted by prior art down light fixture products is directed toward and reflected by the inside of the housing. The result is non-uniform illumination of the wall surface and the presence of dark areas near the intersection of the wall and ceiling. While some have tried to remedy these problems by enlarging the size of the hole in the visible portion of the trim ring assembly, most interior designers find this to be an unacceptable solution.

In the up light embodiment of the present invention 10, the light fixture itself may be set on the floor or permanently mounted in a hole formed in the floor.

In some interior design applications, a wall-wash lighting fixture is used when there is a picture 114 or a sculpture 116 to be illuminated, as shown in FIG. 1. While the following description is centered around a ceiling mounted down light wall-wash fixture, those of ordinary skill in the art will understand that the description of the operation and general construction of the disclosed wall-wash light fixture also applies to floor mounted up-light fixtures.

Figure 2A:
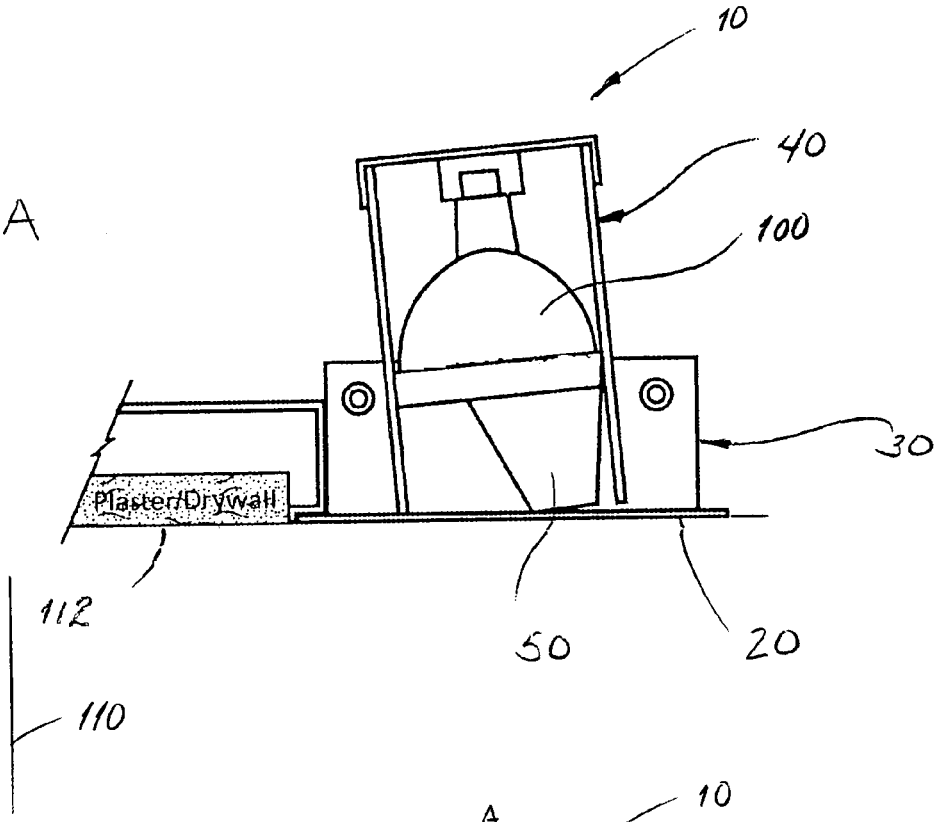
FIG. 2A is a side elevational view of the disclosed down light fixture shown with the lower portion of a trim ring assembly mounted flush with a ceiling surface.
Figure 2B:
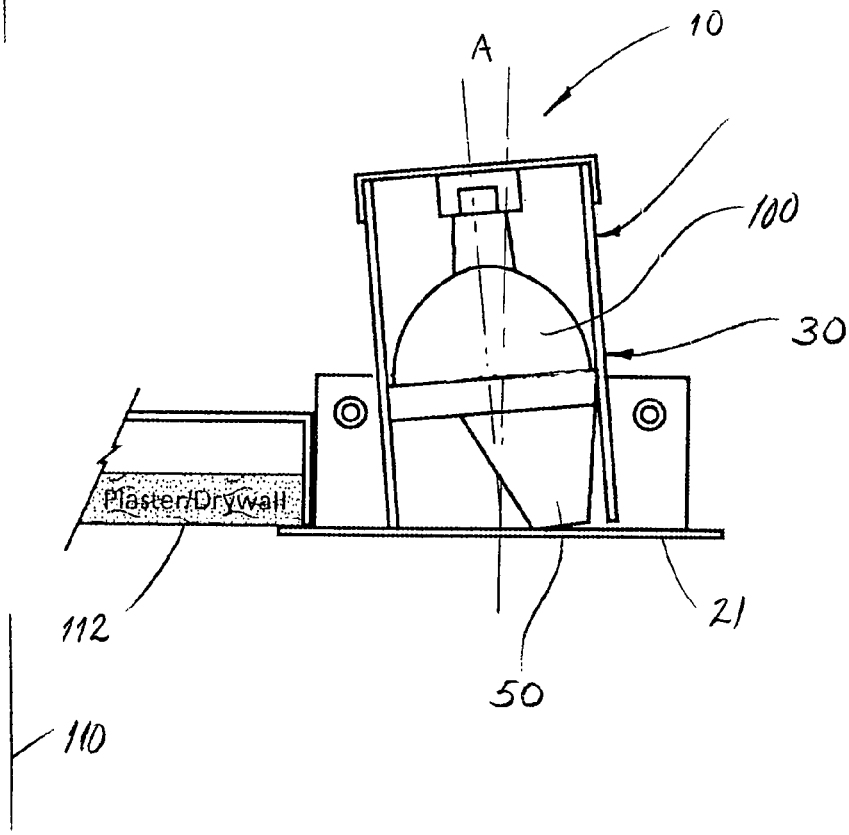
FIG. 2B is a view similar to FIG. 2A with the lower portion of a trim ring assembly positioned against a ceiling surface.

A general understanding of the operation of the wall wash down light of the present invention may be had by reference to FIGS. 2A and 2B. Therein, it may be seen that the wall wash down light assembly of the present invention 10 is designed for mounting through a hole in a ceiling 112. Occupants of the room looking up toward the ceiling will generally notice only the lower or visible portion of the trim ring assembly 20 which is adjacent the ceiling surface and only a small portion which extends in to the bottom part of the housing assembly 30. Those of ordinary skill in the art will understand that multiple types of trim ring assemblies are available and may be used with the present invention. For example, a comparison of FIG. 2A with FIG. 2B will reveal that FIG. 2A shows a trim ring assembly 20 having a lower portion that lays flush with the lower surface of the ceiling 112, while FIG. 2B shows a trim ring assembly 20 including a lower portion constructed to lay against the lower surface of the ceiling 112. It is the preference of most interior designers to minimize the size of the hole in the visible portion of the trim ring assembly 20 through which light passes and to assure that nothing extends into the room under the trim ring assembly 20.

Figure 3:
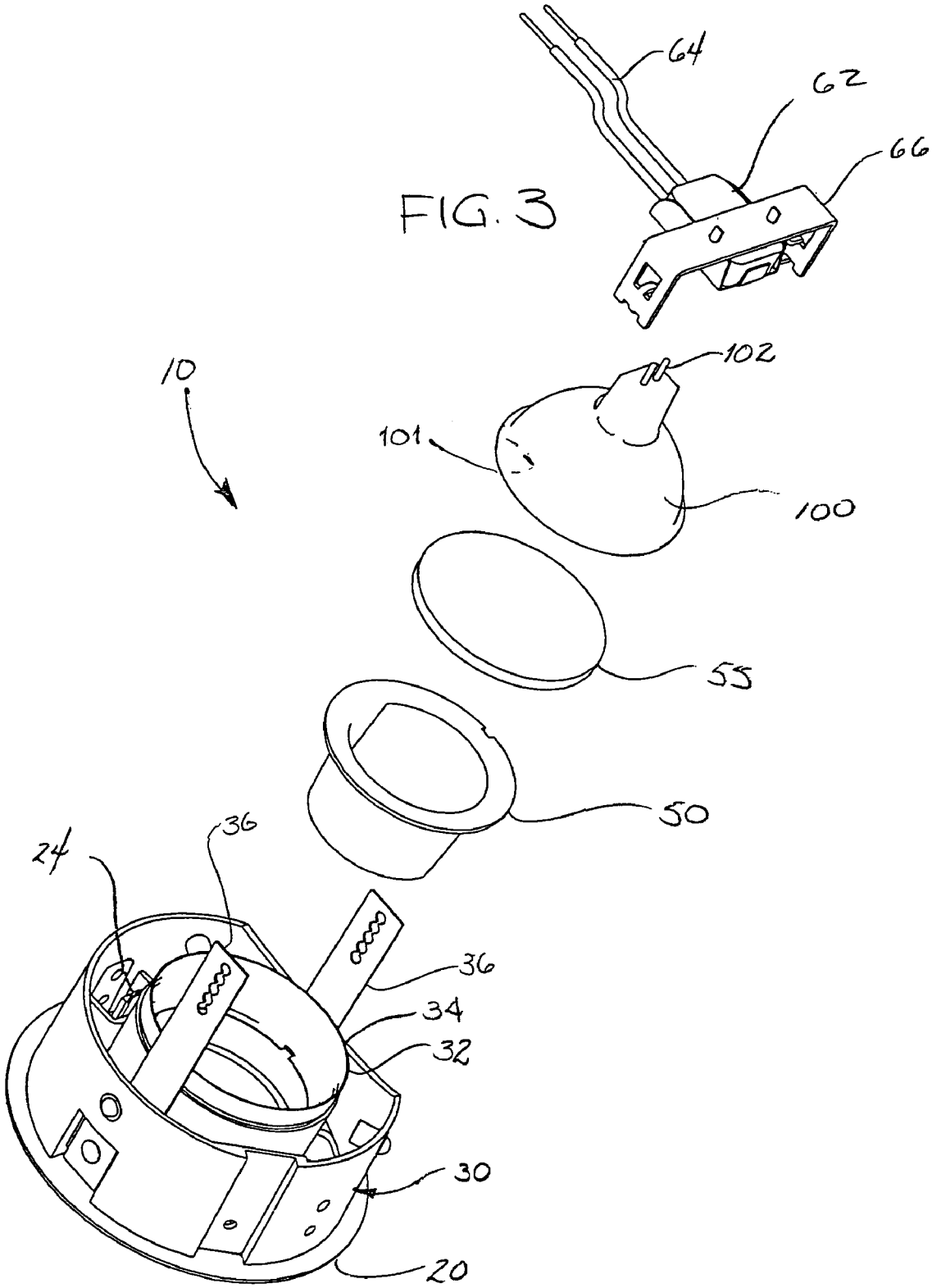
FIG. 3 is an exploded perspective view.

As shown in FIGS. 2A and 2B, a key portion of the wall wash down light assembly 10 is a housing assembly 30 which extends upwardly through a hole in the ceiling 112. Within the housing assembly 30 is the light source positioning ring 32 whose utility is described below with reference to FIG. 3. As may be seen in FIGS. 2A and 3, the light source 100 is tilted away from the wall 110. Shown in FIG. 3 is an MR-16 light source 100 having an internal reflective surface 101. Those of ordinary skill in the area will understand that a variety of different light sources having an internal reflective surface may be used. This tilting of the light source 100 away from the wall 110 enables the light produced by the light source 100 to fall upon the interior curved planar reflecting surface 54 within a substantially arcuate kick reflector 50. The interior curved planar reflecting surface 54 of the substantially arcuate kick reflector 50 both diffuse the light and reflect it back toward the wall 110. It is the combination of the angular mounting of the light source 100, the substantially arcuate shape of the kick reflector 50, and the interior curved planar reflective surface 54 of the kick reflector 50 which disperses the light emanating from the light source 100 so that the wall 110 to be illuminated is illuminated in a substantially uniform manner, and minimizes the presence of dark areas near the intersection of the wall with the ceiling, while at the same time maintaining a relatively small opening in the visible portion of the trim ring assembly 20, through which the light passes.

A still better understanding of the wall wash down light fixture 10 of the present invention for use with an MR-16 light source 100 having an internal reflective surface 101 may be had by the exploded view which appears in FIG. 3. As previously indicated, a trim ring assembly 20 appears at the bottom of the fixture 10. The trim ring assembly 20 may be affixed to the housing authority 30 by a variety of different means 24 such as clips, ball detents, etc., all of which are well known to those of ordinary skill in the art.

Positioned within the housing assembly 30 is a light source positioning ring 32. The light source positioning ring 32 has an angled top surface 34. It is this angled top surface 34 which causes the light source 100 to be positioned at an acute angle A with respect to a plane perpendicular to the plane of the ceiling as shown in FIG. 2B. In the preferred embodiment, angle A is about 3°; however, it has been found that angles from about 1° to about 5° also provide suitable lighting effects. Those of ordinary skill in the art will understand that the light source positioning ring 32 may be adjustably mounted to allow fine tuning of the emitted light beam to match special lighting situations or room geometries. Alternatively, the angled top surface 34 of the light source positioning ring 32 may allow positioning the light source 100 within a pre-determined range of acute angles with respect to a plane perpendicular to the plane of the ceiling.

A close examination of FIG. 3 will reveal that the angled top surface 34 of the light source positioning ring 32 also provides a mounting surface for the substantially arcuate kick reflector 50 and an optional diffusing lens 55. An optional diffusing lens 55 may be included such as a frosted lens, a solex lens, a devon-type spread lens, or any other type lens which provides a specialty lighting effect.

By a comparison of FIG. 2A, FIG. 2B, and FIG. 3, it may be seen that mounting arms 36 are positioned on either side of the light source positioning ring 32. The mounting arms 36 extend upwardly to a cross-piece 66. Further fine tuning of the position of the light source 100 may be accomplished by allowing for a small adjustment of the position of the cross-piece 66 with respect to the mounting arms 36.

The cross-piece 66 provides a mounting for a connector 62 which mates with wires 64 on one side and engages the contacts 102 to provide electrical power to the light source 100. Those of ordinary skill in the art will recognize that FIG. 3 illustrates an MR-16 style light source 100; however, the present invention may be used with a variety of different types of light sources and is not limited to just one style of light source.

The substantially arcuate kick reflector 50 is further depicted in FIGS. 4A and 4B. Specifically, the substantially arcuate kick reflector 50 includes a mounting ring 56 which rests on the light source positioning ring 32 when the disclosed wall-wash down light fixture 10 is assembled.

The arcuate snout portion 52 of the kick reflector 50 is affixed to the mounting ring 56. The curved planar inside surface of the arcuate snout portion 56 forms the interior reflecting surface 54. As previously indicated, it is the curved planar interior reflecting surface 54 which directs the light from the light source 100 toward the wall to be illuminated. If desired, the interior reflecting surface 54 of the kick reflector 50 may be machined, roughened, or formed with a variety of different surfaces to further diffuse any light reflected therefrom. As may be seen in FIG. 4B, the interior reflecting surface 54 is formed at an acute angle B to a plane perpendicular to the plane of the mounting ring 56. In the preferred embodiment, angle B is about 2°. Accordingly, the total deflection angle of the light emitted by the light source is the sum of angle A and angle B or about 5° in the preferred embodiment. Other total deflection angles of from about 3° to about 7° have also provided satisfactory results.

Those of ordinary skill in the art will understand that by placing small shims between the mounting ring 56 of the substantially arcuate kick reflector 50 and the light source mounting ring 32, small adjustments may be made to the size of angle B to fine tune the light pattern falling on the illuminated wall surface. Such small adjustments to the illumination pattern on the wall may also be made by adjusting the relative angle between connector 62, the cross-piece 66, and the light source 100 with respect to the mounting arms 36.

Still further adjustments may be made by changing the arcuate size or the partial substantially circular perimeter of the arcuate snout portion 52. While the preferred embodiment of the kick reflector 50 is shown to be substantially circular, other configurations such as a substantially elliptical shape or a substantially oval shape may be used to solve unique lighting problems. The shape of the kick reflector 50 must be such that the light emitted from the light source 100 encounters a smooth curved planar reflecting surface 54 within the kick reflector 50.

Accordingly, the wall wash light fixture of the present invention uses the combination of the angled mounting of the light source 100, the capture of the light emanated from the light source 100 by the shape of the substantially arcuate kick reflector 50, and the curved planar reflecting surface 54 and substantially arcuate shape of the kick reflector 50 to diffuse the light in a substantially uniform manner to provide a substantially uniform illumination of the wall in close proximity to either a ceiling or a floor in which the wall-wash light fixture of the present invention is mounted.

As will be understood by those of ordinary skill in the art and as shown in FIG. 1, a plurality of wall-wash light fixtures may be used when it is necessary to illuminate a wall having a large surface.

While the present system and method has been disclosed according to the preferred embodiment of the invention, those of ordinary skill in the art will understand that other embodiments have also been enabled. Such other embodiments shall fall within the scope and meaning of the appended claims.

What is claimed is:

1. A wall-wash light system for providing substantially uniform illumination of a wall, said wall-wash light system comprising: a light source including an internal reflector for emitting light; an arcuate kick reflector having an arcuate opening, said arcuate kick reflector constructed and mounted to reflect the light emitted form said light source and direct the light emitted from said light source toward the wall; a mounting for said light source, said mounting constructed and mounted to position said light source near the plane of a ceiling or a floor adjoining the wall and to direct the light emitted form said light source at an acute angle to a plane perpendicular to the plane of the ceiling or of the floor, said mounting being further constructed and mounted to direct said emitted light from said light source away from the wall and toward said kick reflector; whereby the combination of the said mounting for said light source and the reflection of said emitted light form said light source back to the wall by said arcuate kick reflector provides substantially uniform illumination of the wall.

2. The wall-wash light system as defined in claim 1 wherein said acute angle is from about 1 degree to about 5 degrees.

3. The wall-wash light system as defined in claim 1 wherein said kick reflector includes a reflective surface constructed and mounted to diffuse the light emitted by said light source and reflect said emitted light through said arcuate opening.

4. The wall-wash light system as defined in claim 1 further including a light diffusing lens between said light source and said kick reflector.

5. The wall-wash light system as defined in claim 1 further including a trim ring assembly connected to said adjustable mounting.

6. The wall-wash light system as defined in claim 5 further including a housing connected to said trim ring assembly.

7. A wall-wash light fixture for positioning near a wall surface, said wall-wash light fixture comprising: a trim ring assembly; a housing connected to said trim ring assembly, said housing constructed and mounted to provide a mounting for a light source including an internal reflector; a substantially arcuate kick reflector having an arcuate opening, said substantially arcuate kick reflector constructed and mounted to reflect the light rays emitted from said light source toward the wall; a light source positioning ring connected to said trim ring assembly and positioned within said housing; said light source positioning ring including a mounting surface positioned in a plane of a ceiling or a floor adjoining the wall which is at an acute angle with respect to the plane of said trim ring assembly to direct the light emitted from said light source away from the wall; said substantially arcuate kick reflector being positioned by said light source positioning ring to direct the light emitted from said light source back to the wall; whereby substantially uniform illumination of an area on a wall is provided.

8. The wall-wash light fixture as defined in claim 7, wherein said acute angle is from about 1 degree to about 5 degrees.

9. The wall-wash light fixture as defined in claim 8, wherein said substantially arcuate kick reflector diffuses the light emitted from said light source.

10. The wall-wash light fixture as defined in claim 7 further including a diffusion lens between said kick reflector and said light source.

11. A method of providing a substantially uniform light on wall from a light fixture, said method comprising the steps of:

mounting a light source including an internal reflector at an acute angle to a plane perpendicular to the plane of a ceiling or a floor adjoining the wall to direct the light emitted by said light source away from the wall;

mounting a kick reflector to reflect the light emitted by said light source through an opening in said kick reflector back to the wall to provide a substantially uniform level of light on the wall.

12. The method as defined in claim 11, wherein said mounting of the light source including an internal reflector is adjustable.

13. The method as defined in claim 11 wherein said adjustability of said mounting provides an acute angle from about 1 degree to about 5 degrees.

14. The method as defined in claim 11 wherein said step of reflecting the light emitted by said light source employs an arcuate kick reflector.

15. The method as defined in claim 11 wherein said arcuate kick reflector includes a surface for diffusing the light emitted by said light source.

16. The method as defined in claim 11 further including the step of diffusing the light emitted by said light source with a lens before said light is reflected by said arcuate kick reflector toward the wall.

17. The method as defined in claim 11 further including the steps of positioning and mounting a trim ring assembly to a housing constructed and mounted to provide a mounting for said light source.

18. A system for providing substantially uniform illumination of a wall, said system comprising: a plurality of individual light fixtures, each of said individual light fixtures including: an individual light source including an internal reflector for emitting light; an adjustable mounting for positioning said individual light source at an acute angle with respect to a plane perpendicular to either a ceiling or a floor adjoining the wall; a substantially arcuate kick reflector having an arcuate opening, said substantially arcuate kick reflector constructed and mounted for directing the light emitted from said individual light source toward the wall; said adjustable mounting constructed and mounted to direct the light from said individual light source away from the wall and toward said substantially arcuate kick reflector for reflection back to the wall; a housing for positioning said adjustable mounting; a trim ring assembly connected to said housing; whereby the combination of the positioning of said individual light source and said substantially arcuate kick reflector within the plurality of individual light fixtures provides a substantially uniform level of illumination on the wall.

* * * * *